United States Patent [19]

Wippermann et al.

[11] 4,354,619

[45] Oct. 19, 1982

[54] CONTAINER FOR THE DISPENSING OF TABLETS ONE BY ONE

[75] Inventors: Gerhard Wippermann, Brüggen; Peter Keller, Duisburg, both of Fed. Rep. of Germany

[73] Assignee: Bramlage GmbH, Lohne/Oldenburg, Fed. Rep. of Germany

[21] Appl. No.: 155,271

[22] Filed: Jun. 2, 1980

[30] Foreign Application Priority Data

Jun. 1, 1979 [DE] Fed. Rep. of Germany ..... 2922350
May 7, 1980 [DE] Fed. Rep. of Germany ..... 3017376

[51] Int. Cl.[3] ..... B65D 83/04

[52] U.S. Cl. ..... 221/263; 221/289; 221/312 C; 206/540

[58] Field of Search ..... 221/186, 263, 264, 268, 221/289, 292, 312 R, 312 C; 206/528, 540

[56] References Cited

U.S. PATENT DOCUMENTS 887,747 5/1908 Anderson ..... 221/263 X
939,252 11/1909 Hanna ..... 221/186
2,035,246 3/1936 Rea ..... 221/264 X
2,149,445 3/1939 Kreiten ..... 221/289 X
3,059,762 10/1962 Yoshimoto ..... 206/540

FOREIGN PATENT DOCUMENTS 1315861 12/1962 France ..... 206/540

*Primary Examiner*—Joseph J. Rolla
*Attorney, Agent, or Firm*—Martin A. Farber

[57] ABSTRACT

A container for the dispensing of tablets one by one in which, below a drop-out chamber arranged below a sorting trough the container wall has a tablet drop-out opening in front of which, in each case, one of the tablets is released by spring-loaded sliding movement so as to drop out. Two housing caps supplement each other to form the container and can be telescopically inserted one within the other, one of the housing caps forming the drop-out chamber below the sorting trough which is formed by the two housing caps together, the drop-out opening of the chamber being closed in the relaxed position of the spring by a wall section of the other housing cap, the last-mentioned housing cap having a division finger which in the pushed-together position of the two housing caps closes off the sorting trough from the drop-out chamber.

14 Claims, 12 Drawing Figures

3
3''
22
24
23
19
21
10
11
20
18
2'
8
AF
III
III
16''
16
15
4
8'
18'
5'
3'
5
7'
AS
14
13
12
6
7
9
4
2''
1
A
2

AF
AS
A
Ö
X
XII

CONTAINER FOR THE DISPENSING OF TABLETS ONE BY ONE

The present invention relates to a container for the dispensing of tablets one by one, in which, below a drop-out chamber arranged below a sorting trough, the wall of the container has a tablet drop-out opening, in front of which in each case one of the tablets is released by spring-loaded sliding movement so as to drop out.

A container of this type developed in the shape of a bowl is already known in which the bottom of the bucket is continued downward by a sorting trough developed in the shape of a trench. The trough terminates in a drop-out chamber in the form of a slide which is supported for transverse displacement and which receives the lowest tablet and conducts it by a sliding motion into the region of the drop-out opening. The rest of the content is shut off in this connection by the slide. As actuating means a press button present in the base of the bowl is used. This button is adapted to the shape of the base of the bowl, which has a corresponding aperture. The base itself is developed without a bottom except for the guide channel to the slide, so that a relatively sharp edge of the vessel is present. Furthermore, the part of the vessel which forms the delivery mechanism takes up approximately half of the volume. Dispensers of this type can therefore not be used as so-called pocket packages which can be carried along with one. Furthermore, the lid can in such case easily become loose.

The object of the present invention is to develop a container of the above type for the dispensing the contents thereof one by one, consisting, for instance, of tablets, in a structural form which is simple to manufacture, and more reliable and handier to use so that it can even be carried along with one as a so-called pocket package.

This object is achieved by the subject matter of the invention by two housing caps which supplement each other to form the container and can be telescopically inserted one within the other, one of the housing caps forming the drop-out chamber below the sorting trough which is formed by the two housing caps together, the drop-out opening of the chamber being closed in the relaxed position of the spring by a wall section of the other housing cap, the last-mentioned housing cap having a division finger which in the pushed-together position of the two housing caps closes off the sorting trough from the drop-out chamber.

By this development there is provided a container, developed as a so-called tablet dispenser, which is in particular of increased utilitarian value. The container consists simply of two housing caps which are inserted one within the other and can be displaced with respect to each other. A separate lid, as a further structural part can be dispensed with entirely. Accordingly, there is also no danger of the lid coming off when the container is carried along with one by the mechanical stresses produced thereby. The two housing caps together form the sorting trough and, at the lowest point, the drop-out chamber which is closed in the relaxed position of the spring by a section of the wall of the other housing cap. Only the further pushing together of the two housing caps leads to the coinciding alignment of the drop-out chamber containing a tablet in ready-to-dispense position and the drop-out opening. The other housing cap has a division finger which closes off from the remaining sorted supply by closing the gate which lies at the lowest point of the sorting trough; the individual dispensing is effected with a high degree of reliability and with extremely gentle treatment for the body of the tablets. As an advantageous further development, an ejection finger on the one housing cap lies, extending in opposite direction, opposite the division finger so that the two fingers pass practically into each other in the pushed-together position of the housing caps. Such fingers can easily be produced by injection molding in the form of mandrel-like projections. Since they are rooted in the bottom of the caps they at the same time provide a reinforcement there. Accordingly, one can employ extremely small cross sections of the wall. The two housing caps form a pull-out limitation stop. This stop is formed in the simple manner by a disengageable detent projection. The latter is developed as a catch as its rear surface which facilitates assembly providing a plug-type assembly which facilitates the coupling together of the two housing caps. After the two housing caps have been assembled, the detent projection extends, in a manner advantageous for construction, into the drop-out opening of the other housing cap, i.e. the housing cap which lies on the outside, where it rests against the edge of the corresponding opening. In order to refill the pocket package it is merely necessary to push the wall section forming the detent protection slightly inward. This region can be possibly made more flexible by means of longitudinal slits. The resiliency of the material used, for instance plastic, can be utilized in favorable manner also for the development of the restoring spring. The development with respect hereto is such that the spring which is formed on the narrow wall of the one housing cap is developed as a bent spring blade which rests against the bottom of the other housing cap. As a support trough there can furthermore be used the corner spaced between division finger and bottom of the cap. The width of the spring blade is in this connection advantageously adapted to the inside width of the interior of the container so that tablets cannot get behind the spring.

Since in order to obtain a suitable sliding guidance elongated housing caps are used, automatic vertical filling is difficult. In particular in the case of small pocket packages too little standing surface remains as well as too small an opening cross-section for a filling spout. A disciplined control of the relatively small, light housing caps on a conveyor belt is extremely difficult. In order to improve, in particular, the prerequisites for automatic filling while retaining the functionally advantageous development of such a container which has been achieved, the side wall of the one housing cap forms a window-like opening which is open during the plugged-in connection position of the two housing caps and is closed in the unoperated basic position by a part of the side wall of the other housing cap. The automatic filling of the container can now be effected more rapidly and in particular more economically. No wrong filling occurs. It is no longer necessary now to apply the one housing cap only after the filling of the other housing cap. In particular it is no longer necessary to fill via the narrow cross section of the end surface. Rather the unit can be completely pre-assembled. It is larger in surface and accordingly easier to guide, hold and direct.The structural means are so developed that the one side wall of the housing cap leaves the window-shaped opening free with a partially closed plug-in connection of the two housing caps, this opening being closed in the unoperated basic position by a portion of the side wall of the other housing cap. The opening, which is to be made as large as possible, therefore is located in a region which in the basic position of the container is again completely covered by the other housing cap. Sufficiently larger overlapping guide sections are in any event present due to the basic design of the corresponding container. To this extent also there is no further expenditure of material, or rather material is even saved by the providing of a window-shaped opening. The pre-engagement of the two housing caps is obtained in the manner that the position corresponding to the open window is assured by detents which spring elastically one over the other on the end edge of the two housing caps. After the filling, the housing caps must then be pushed into each other by the application of an intentional force. In order that in this position the sliding movement is not prevented by the protruding detent means, the further development is such that in the unoperated basic position the corresponding detents of the one housing cap lie within free-travel slots of the other housing cap. Corresponding free-travel slots can easily be formed simultaneously from a standpoint of molding technique. In order to keep the spring which urges the dispenser in the direction of the basic operating position out of action during the filling process, there is intentionally selected a development in connection with which, in the position corresponding to the open window, the spring legs of a spring blade which extend from the end edge of the one housing cap lie at a distance from the bottom of the other housing cap. The spring therefore only comes into position of readiness for action when the container is brought into its unoperated basic position. An advantageous development of the spring is obtained if the two spring legs which lie in different planes offset to each other extend, at an acute angle to each other, from a carrying strip which is clipped to the region of the end edge of the one, i.e. the inner, housing cap. Before bringing about the explained pre-detent position, the spring blade can be conveniently associated with one housing cap if it is not in any event an integral component of the one housing cap, i.e. formed thereon or integral therewith. Otherwise, however, the spring body is constructed such that the supporting strip extends over the entire end surface of the housing cap and has at least one passage opening for the division finger. The supporting strip thereby at the same time forms the cap wall. In this way the filling material cannot pass into the other housing cap. The final assembly is facilitated.

Other advantages and details of the subject matter of the invention are explained in further detail below with reference to two embodiments shown in the drawing, in which.

Figure 1:
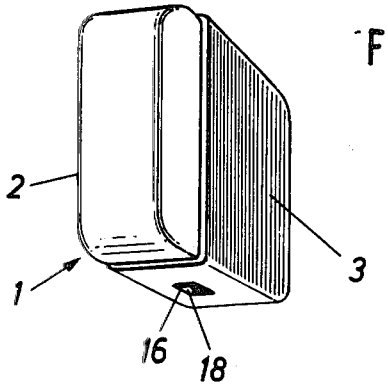
FIG. 1 shows the box-shaped container as a pocket package in accordance with the first embodiment, seen in a perspective view.

The container 1 which is developed in the form of a compact, flat pocket package consists in both embodiments of two housing caps 2,3 adapted to be inserted one within the other and which supplement themselves to form an inner space A which is closed on all sides and receives disk-shaped filling material such as, for instance, tablets 4.

The two housing caps 2, 3 can be displaced from their unoperated basic position, i.e. the closed position (FIGS. 4 and 11), telescopically against spring biasing into one another to an extent limited by a stop.

The one housing cap 2 forms, in its lower wall section 2', a drop-out chamber 5 which in the closed position of the container 1 is covered by the wall section 3' of the other housing cap 3 which extends in front of it.

Figure 3:
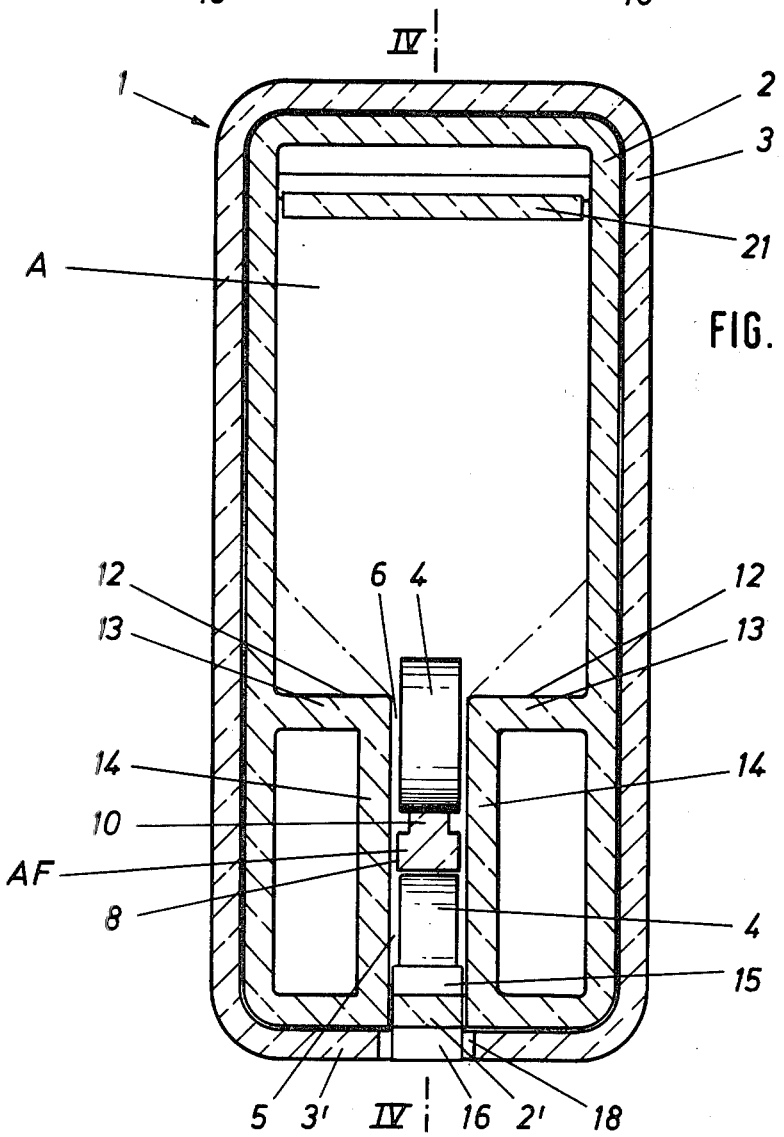
FIG. 3 is a section along the line III—III of FIG. 4.

The two housing caps 2, 3 together form, above the drop-out chamber 5, a funnel-shaped sorting trough 6. There are concerned here ribs 7,8 which protrude freely from the bottom 2'' and 3'' of the housing caps 2, 3 respectively. These ribs terminate in the basic position of the container ready for operation with their ends 7' and 8' respectively spaced a distance apart from each other which corresponds to the length of the drop-out chamber 5, i.e. they permit the passage of only one tablet 4. The ribs 7 and 8 extend substantially horizontally. For reasons of injection molding technique they can converge slightly towards their free ends. In the case of the first embodiment there extends from the back of the ribs upward-directed ledges 9 and 10 respectively rooted in the bottoms 2'' and 3'' of the housing caps 2, 3 respectively. The ledge crest is developed so as to descend in elongated or arcuate manner in the direction of the drop-out chamber 5, corresponding to the desired concave bottom-trench shape of the sorting trough. The ledge 8 is closed off on top by another rib 11. At the height of the rib the sorting trough 6 forms, on both sides, a horizontally extending shoulder 12. These shoulders instead of being of the shape shown in solid lines in FIG. 3 can also be oblique, forming a transverse funnel which favors the sliding of the tablets 4 into the sorting trough 6. The transverse walls 13 which form the shoulders 12 stiffen the inner housing cap 2. They pass into vertical walls 14 which laterally define the sorting trough 6 and are rooted in the wall section 2' there.

Figures 9, 10, 11:
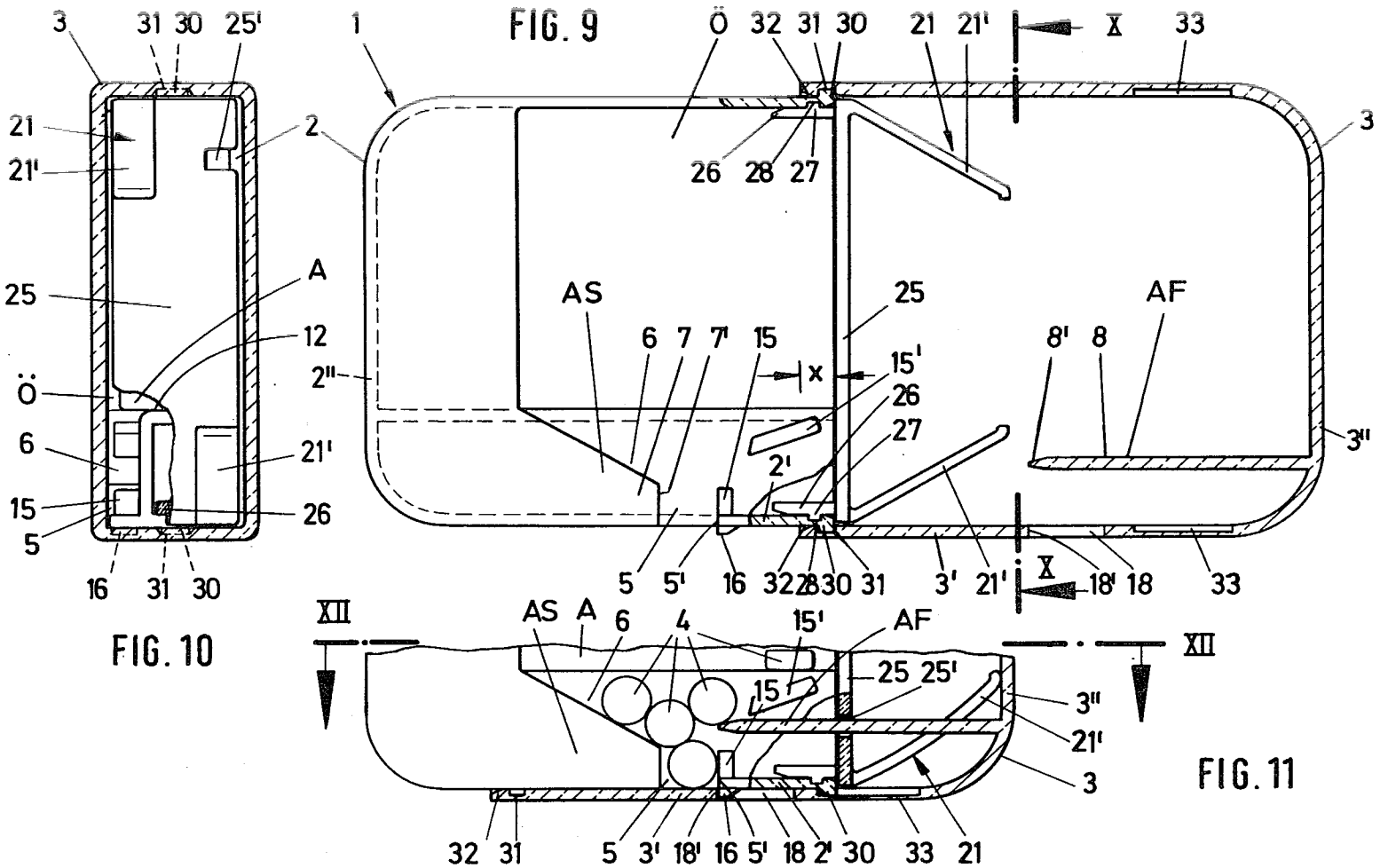
FIG. 9 is a corresponding view in cross section on a scale larger than that of FIG. 8.
FIG. 10 is a cross section along the line X—X of FIG. 9.
FIG. 11 is a cross section similar to FIG. 10 but with the container in its unoperated basic position.

In the case of the second embodiment, there is another ledge 15' above the rib 8. It points obliquely downward in the direction of the drop-out chamber 5. The sorting trough 6 passes in the lower third of this cap into the horizontal shoulder 12, which extends up to the end edge of the cap. The longitudinal edge on the sorting trough side thereof is rounded so that the tablets 4 which rest thereon can slide down from the shoulder 12 to the bottom of the sorting trough 6 (FIG. 9).

In both embodiments, the rib 8 forms a horizontally extending division finger AF and the rib 7 which also extends horizontally but lies displaced vertically in its plane, forms an ejection finger AS. The height of the ejection finger AS takes into account the diameter of the tablet 4. The other side of the drop-out chamber 5 is limited by a ledge 15 of approximately the same height which, adjoining an opening, continues into the ledge 15' (FIG. 11).

In the region of its edge 5' the wall section 2' present there forms an outward directed projection 16. This projection is beveled in the manner of a latch at its rear surface. This development favors the plug-in assembling of the two housing caps 2, 3 in that the rear surface forms practically a run-on bevel for the inner edge of the end edge of the other housing cap 3. The detent projection 16 travels in this connection over the inner surface of the corresponding wall section 3' of the housing cap 3 until finally, as a result of the resiliency of the material, it snaps behind the edge 18' of an opening in the housing cap 3, which opening forms the drop-out opening 18.

The drop-out opening 18 is of such a length that upon the telescopic inter-insertion of the two housing caps 2, 3 an opening is exposed which is so large that the tablet carried along by the ejection finger AS passes outwardly through the drop-out opening 18 without jamming.

This displacement is effected against the action of a spring blade 21. In accordance with the first embodiment the latter is formed on the lid-side narrow wall of the housing cap 2. This is a thin-walled tab which extends beyond the end surface 19 of this housing cap 2. The tab, in an unassembled condition, has an elongated course approximately parallel to the lid-side narrow wall. In assembled condition, the spring blade 21 assumes a curved course. Its end surface 22 rests in the corner between the rib 11 and the bottom 3'' of the housing cap 3. Its width corresponds essentially to the inside opening of the container inner space A. It thus keeps the rear space which is necessary for the spring action free of filling material.

Figure 4:
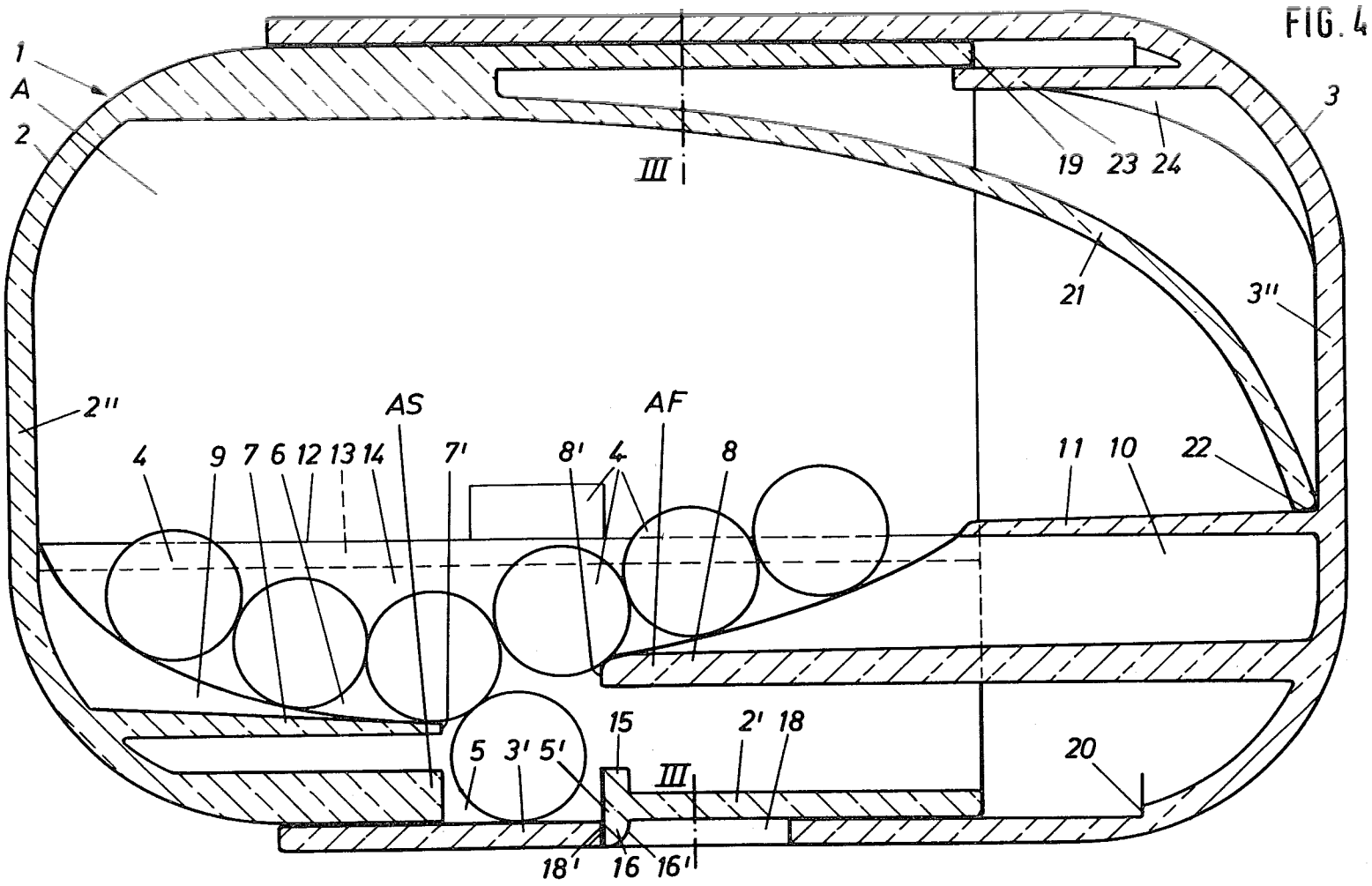
FIG. 4 is a section along the line IV—IV of FIG. 3, shown in closed position.
Figure 5:
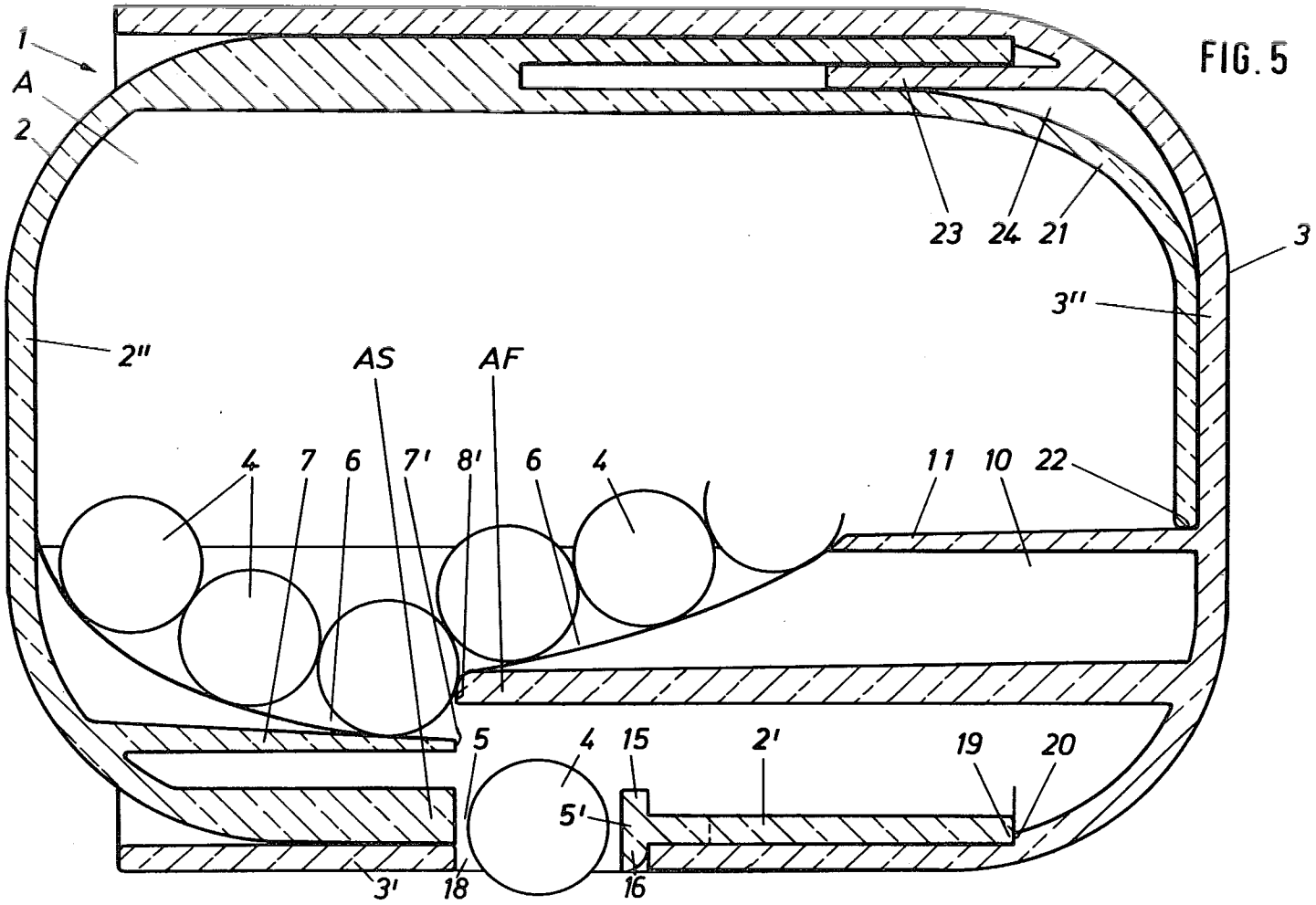
FIG. 5 is a corresponding section in the pushed-together position of the two housing caps for the dispensing of an individual unit of the content.

As can be noted from FIGS. 4 and 5, the container has at least one guide section 23 which slides over itself. Such a rib-like guide section 23 which also supports the cap wall from the inside and extends parallel to the ribs 8 and 11 and comes practically also from the bottom 3'' of the housing cap 3, is stabilized in its turn by a ledge 24 on the side of the section facing the inner space A of the container. This ledge has a contour which corresponds essentially to the curvature of the spring and forms a stiffening for the guide section 23, which otherwise extends freely. In the pushed-together position of the housing caps 2, 3, the spring blade 21 rests against this contour of the ledge 24 (see FIG. 5).

The leaf spring extends from a thickened wall zone of the housing cap 2.

The cap bottom 2'' of the housing cap 2 as well as that of the housing cap 3 extend via large curvatures into the wall sections 2' and 3' respectively as well as into the lid-side cap side walls.

Figure 2:
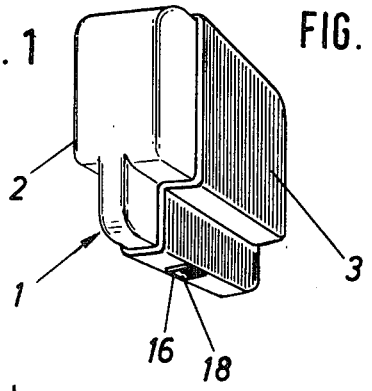
FIG. 2 is a variant in a similar showing.

Instead of being developed in the definitely box-shaped embodiment shown in FIG. 1, the container can also be shaped in the manner shown in FIG. 2 where the housing section which forms the drop-out opening 18 is of definite keel shape.

The pushing surfaces of the housing caps 2,3 can be grooved to assure a better grip.

In the second embodiment (FIGS. 6–12) the spring blade 21 is developed as a separate plug part. It forms two spring arms 21 which are convergent, i.e. extend at an acute angle toward each other. The said arms are rooted in a common supporting ledge 25. The latter has detent tabs 26 formed on it. Each of the detent tabs 26 bears on the outside a detent projection 27 which clips into a corresponding detent recess 28 on the inside in the endedge region of the one, i.e. inner, housing cap 2. The supporting ledge 25 is of such length that it engages over the end edge of the housing cap 2, which end edge forms one plug-in end stop (see FIG. 10), and therefore in lid-like fashion covers the end surface there. Thus no filling material can pass into the housing cap 3 which forms the spring chamber. The supporting ledge 25 merely leaves a form-fitting passage opening 25' in the region of the division finger AF. Another said opening is provided on the opposite side so that the part can be mounted as desired.

The spring arms 21' are arranged offset in different planes on the supporting ledge 25 in such a manner that they can even come into an overlapping scissor-like position whereby a soft, non-hooking spring function is obtained.

Figure 7:
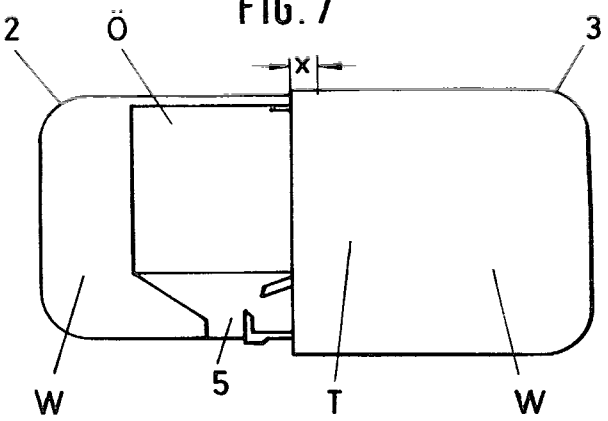
FIG. 7 shows the container in the pre-detent position which leaves a window-like opening present, seen in top view.
Figure 6:
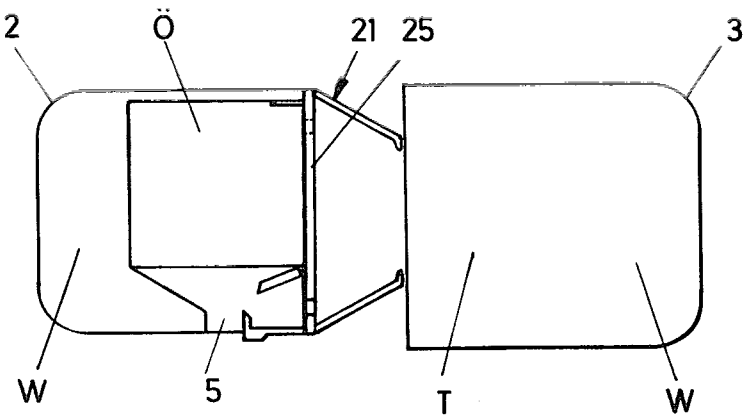
FIG. 6 shows the container in accordance with the second embodiment before the housing caps have been pushed together, seen in top view.
Figure 12:
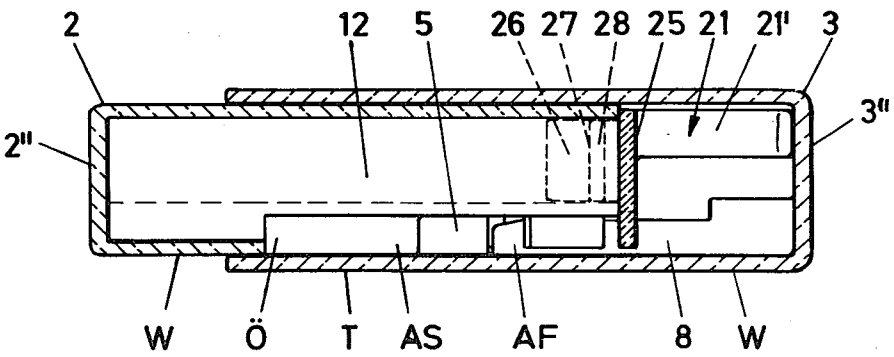
FIG. 12 is a section along the line XII—XII of FIG. 11.
Figure 8:
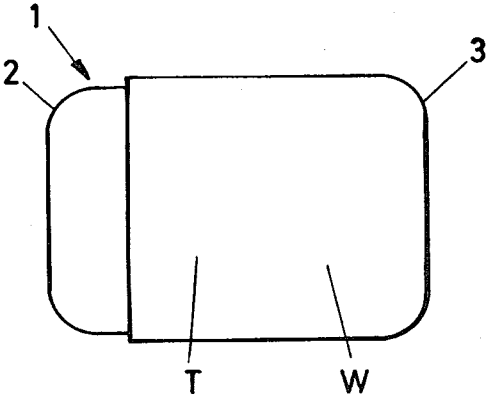
FIG. 8 shows the container in the unoperated basic position.

The filling of the container 1 is effected from the wide side. For this purpose a window shaped opening O is left in the housing cap 2. This opening O is located in one of the two relatively large-area side walls W of the container 1 and is free only in the partially interconnected position of the two housing caps 2, 3 (FIGS. 7, 9). In the unoperated basic position shown in FIG. 8 this window-shaped opening O on the other hand is closed by a partial region T of the corresponding side wall W of the other housing cap 3. As shown in the drawing, the window-shaped opening O is provided in the interior cap 2 of the two housing caps 2, 3.

The readiness-for-filling position (FIGS. 7, 9) is secured by detent action. In this position, the housing caps 2, 3 engage into each other only over a short overlapping distance X (FIG. 7) of a few millimeters. In the region of the end edge of one housing cap 2 outwardly-directed detent projections 30 are formed on the narrow wall sections. These projections engage into detent depressions 31 lying in coinciding position in the corresponding wall sections 3' of the other housing cap 3. The end edge of this housing cap 3 is widened slightly in funnel shape so that for the detent projections 30 run-on ramps 32 which facilitate the plug-in coordination . . . . are provided. Facilitation of the plug-in coordination is effected also by the fact that the window-shaped opening Ö extends from the front edge of the housing cap 2.

In the unoperated basic position the detent projections 30 of the housing cap 2 lie in free-travel slots 33 of the other housing cap 3.

The detent recess 31 and the detent projection 16, lie as evident from FIG. 10, offset in different planes, thus laterally adjacent one another, so that no disturbances occur, i.e., the catch projection 16 does not also snap into the catch recess 31 upon the end mounting.

The spring blade 21 to be coordinated before the plug-in assembly of the housing cap 2 causes no spring forces in the pre-detent position (FIG. 9), inasmuch as in the position corresponding to the open window the spring leg 21' which extends from the front edge of the one housing cap is spaced from the bottom 3' of the other housing cap, which bottom 3' forms the spring abutment.

The sorting-stretch sided side wall of the housing cap 2 is cut back forming therewith the tablet shaft (compare FIG. 10). As a consequence of the opening Ö the partial range T of the side wall W of the outer housing cap 3 acts as a position changeable shaft wall. In this manner the dispensing goods which fall in the range of the sorting trough 6 are disaggregated and held without being clamped. By pulling the housing caps 2, 3 out from one another until in the pre-detent position (FIG. 7) the container 1 comfortably is fillable-up and respectively refillable.

We claim:

1. In a container for the dispensing of tablets one by one in which, below a drop-out chamber arranged below a sorting through, a container wall has a tablet drop-out opening in front of which, in each case, one of the tablets is released by spring-biased sliding movement so as to drop out, the improvement wherein two housing caps complementarily formed and telescopically insertable within each other form the container and an inner storage space for the tablets, one of said housing caps forms said drop-out chamber below said sorting trough, said sorting trough is formed cooperatively by said two housing caps, spring means for spring-biasing said housing caps, the other housing cap is formed with a section of a wall closing said drop-out opening from said drop-out chamber in an unoperated basic position of said housing caps in a relatively unstressed position of said spring means, said other housing cap having a division finger, said division finger closes off said sorting trough from the drop-out chamber in a pushed-together position of said two housing caps, a side wall of said one housing cap is formed with a window which is open to the outside and communicates with the storage space in a plugged-in connection position of said two housing caps, said window is closed in said unoperated basic position of said housing caps by a partial region of a side wall of said other housing cap.

2. The container according to claim 1, wherein said window is a large opening formed in an enlarged side wall of said one housing cap and is substantially larger than said drop-out opening and a plurality of the tablets.

3. The container according to claim 1, wherein said window extends beyond an edge of said other housing cap in said plugged-in connection position.

4. The container according to claim 1, wherein said window extends from a front edge of said one housing cap.

5. The container according to claim 1, further comprising elastically springing-over detent means for securing said plugged-in connection position of said open window, said detent means are arranged on end edges of said two housing caps, said other housing cap is formed with free-travel slots, said detent means include projections on said one housing cap, in said unoperated basic position of said housing caps said projections are disposed in said free-travel slots of said other housing cap.

6. The container according to claim 5, wherein one of said detent means comprises recesses on said end edge of said other housing cap in which said projections engage in said plugged-in connection position.

7. The container according to claim 6, wherein said drop-out opening is formed in said other housing cap and communicates with said drop-out chamber in said pushed-together position of the two housing caps, said one housing cap has a projection disposed in said drop-out opening engaging one end of the latter in said basic position, said projection and said recesses are off-set in different planes laterally adjacent each other.

8. The container according to claim 5, wherein said detent means engages a beginning end of said free-travel slots in said basic position and is held in said basic position by said spring means in said relatively unstressed position, said detent means for being displaceable in said free-travel slots when said two housing caps are pushed together moving said two housing caps into said pushed-together position.

9. The container according to claim 8, wherein said unoperated basic position of said two housing caps is between said pushed-together position and said plugged-in connection position.

10. The container according to claim 1 or 8, wherein said drop-out opening is formed in said other housing cap and communicates with said drop-out chamber in said pushed-together position of the two housing caps, said one housing cap has a projection disposed in said drop-out opening engaging one end of the latter in said basic position.

11. In a container for the dispensing of tablets one by one in which, below a drop-out chamber arranged below a sorting trough, a container wall has a tablet drop-out opening in front of which, in each case, one of the tablets is released by spring-biased sliding movement so as to drop out, the improvement wherein two housing caps complementarily formed and telescopically insertable within each other form the container, one of said housing caps forms said drop-out chamber below said sorting trough, said sorting trough is formed cooperatively by said two housing caps, spring means for spring-biasing said housing caps, the other housing cap is formed with a section of a wall closing said drop-out opening from said drop-out chamber in a relatively unstressed position of said spring means, said other housing cap having a division finger, said division finger closes off said sorting trough from the drop-out chamber in a pushed-together position of said two housing caps, a side wall of said one housing cap is formed with a window which is open in a plugged-in connection position of said two housing caps, said window is closed in an unoperated basic position of said housing caps by a partial region of a side wall of said other housing cap, said spring means comprises a spring blade extending from an end edge of said one housing cap and having two spring arms spaced from a bottom of said other housing cap in said plugged-in connection position.

12. The container according to claim 11, wherein said two spring arms are disposed offset from each other in different planes and oriented at an acute angle relative to each other, a supporting ledge is clipped to a region of said end edge of said one housing cap, said two spring arms extend out from said supporting ledge, said one housing cap constitutes an inner of said two housing caps.

13. The container according to claim 12, wherein said supporting ledge extends over the entire end area of said one housing cap and is formed with at least one passage opening adapted for said division finger to pass therethrough.

14. In a container for the dispensing of tablets one by one in which, below a drop-out chamber arranged below a sorting trough, a container wall has a tablet drop-out opening in front of which, in each case, one of the tablets is released by spring-biased sliding movement so as to drop out, the improvement wherein two housing caps complementarily formed and telescopically insertable within each other form the container, one of said housing caps forms said drop-out chamber below said sorting trough, said sorting trough is formed cooperatively by said two housing caps, spring means for spring-biasing said housing caps, the other housing cap is formed with a section of a wall closing said drop-out opening from said drop-out chamber in a relatively unstressed position of said spring means, said other housing cap having a division finger, said division finger closes off said sorting trough from the drop-out chamber in a pushed-together position of said two housing caps, said one housing cap is formed with an ejection finger directed in opposite direction to and disposed opposite said division finger and such that said two fingers are positioned one above the other when said housing caps are pushed together.

* * * * *